US011560719B2

(12) United States Patent
Winter

(10) Patent No.: US 11,560,719 B2
(45) Date of Patent: Jan. 24, 2023

(54) ELBOW ASSEMBLY FOR RAMP AND PLATFORM ASSEMBLY

(71) Applicant: Homecare Products, Inc., Auburn, WA (US)

(72) Inventor: Ronald S. Winter, Pacific, WA (US)

(73) Assignee: HOMECARE PRODUCTS, INC., Auburn, WA (US)

( * ) Notice: Subject to any disclaimer, the term of this patent is extended or adjusted under 35 U.S.C. 154(b) by 730 days.

(21) Appl. No.: 16/509,133

(22) Filed: Jul. 11, 2019

(65) Prior Publication Data

US 2021/0010273 A1 Jan. 14, 2021

(51) Int. Cl.
*E04F 11/18* (2006.01)
*E04F 11/00* (2006.01)

(52) U.S. Cl.
CPC ..... *E04F 11/1836* (2013.01); *E04F 11/002* (2013.01)

(58) Field of Classification Search
CPC ..... F16B 7/025; F16B 7/042; F16C 11/04; Y10T 403/5793; Y10T 403/7064; Y10T 403/7066; Y10T 403/7067; Y10T 403/7069; E04F 11/1836; E04F 11/002; E04F 11/1808; E04F 11/1817; E04F 11/1834; E04F 2011/1819; E04F 2011/1825; E04F 2011/1827; E04F 2011/1834; E04F 2011/1838; E04H 17/1448
USPC ..... 256/65.01, 67, 65.02, 65.15, 65.08; 403/205, 295, 314, 408.1, 409.1
See application file for complete search history.

(56) References Cited

U.S. PATENT DOCUMENTS

| | | | | |
|---|---|---|---|---|
| 4,767,232 | A * | 8/1988 | Francis | E04F 11/1834 403/113 |
| 2002/0110406 | A1* | 8/2002 | Coles | F16B 7/185 403/57 |
| 2004/0036222 | A1* | 2/2004 | Chou | A63B 63/004 473/478 |
| 2005/0199868 | A1* | 9/2005 | Morris | E04F 11/1836 256/73 |
| 2012/0326108 | A1* | 12/2012 | Eves | E04F 11/1836 256/60 |
| 2014/0191177 | A1* | 7/2014 | Bailie | E04F 11/1834 256/67 |
| 2021/0002904 | A1* | 1/2021 | Mornan | F16B 7/0446 |

* cited by examiner

*Primary Examiner* — Kyle J. Walraed-Sullivan
(74) *Attorney, Agent, or Firm* — Polsinelli PC

(57) ABSTRACT

The present disclosure provides elbow assemblies for ramp and platform assemblies, and ramp and platform assemblies. The elbow assembly includes a first elbow sub-part that is configured to nest within a second elbow sub-part. The elbow assembly includes useful features, including structure that enables direct connection either to a tubular support member or a flat portion of a support member, and structure that provides a smooth transition between the first elbow sub-part and the second elbow sub-part at any angle within the range of motion.

19 Claims, 17 Drawing Sheets

ELBOW ASSEMBLY FOR RAMP AND PLATFORM ASSEMBLY

BACKGROUND

Modular ramp and platform assemblies generally may include deck surfaces, legs, and handrails. These modular assemblies can be configured to provide ramping and horizontal deck surfaces to provide access, for example, if a user needs to travel from elevation A to elevation B, but is not able to traverse stairs or a steep slope to get there.

Because the modular assemblies typically change path directions, for example, switching back from a first direction to a second direction, the handrails are joined at connectors (such as the elbows described herein) to provide a continuous handrail, but also to accommodate these direction changes. To accommodate a wide range of direction changes, it is desirable to have an elbow with a large range of movement.

The modular assemblies may include elements for handrails formed of tubing (e.g., square, rectangular, circular, oval, polygonal, or any other corresponding shape) and/or pieces having one or more flat surfaces (such as 90 degree angle aluminum). It is therefore desirable to have an elbow that can connect to tubing and/or flat surfaces. As used in this disclosure, "tubing" or "tubular" may refer to tubing having a cross sectional shape that is square, rectangular, circular, oval, polygonal, or any other shape.

Embodiments of the present disclosure are directed to fulfilling these and other needs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In an aspect, the present disclosure provides an elbow assembly for a ramp and platform assembly. The elbow assembly includes a first elbow sub-part and a second elbow sub-part that are selectably and hingeably connectable to each other by a joining device. Each of the first and second elbow sub-parts have a body defining a distal end, a proximal end, and a longitudinal axis extending therethrough. The body has a base portion and a connecting portion. The base portion extends from the distal end to an intermediate position located between the distal end and the proximal end, and the base portion is configured for insertion into a tubing member. The connecting portion extends from the intermediate position to the proximal end, and has an arm portion and a guard portion. The arm portion extends to an end surface at the proximal end and has a first interface surface that is parallel to the longitudinal axis. The guard portion has a first concave surface and a second concave surface that are oriented toward the arm portion, and a first outer edge of the first concave surface meets the arm portion at a first stop, and a second outer edge of the second concave surface meets the arm portion at a second stop. When the first elbow sub-part is connected to the second elbow sub-part, the second elbow sub-part is configured to pivot relative to the first elbow sub-part within a range of motion between the first stop and the second stop, the first interface surface of the first elbow sub-part interfaces with the first interface surface of the second elbow sub-part, the end surface of the first elbow sub-part nests between the first interface surface and at least one of the first concave surface or the second concave surface of the second elbow sub-part, and the end surface of the second elbow sub-part nests between the first interface surface and at least one the first concave surface or the second concave surface of the first elbow sub-part.

In an aspect of the elbow assembly, the distal end of the base portion of the body of each of the first and second elbow sub-parts may be configured to attach directly to a flat portion of a support member via a joining member that extends through a central bore of the base portion and through the flat portion of the support member. In another aspect, each of the first elbow sub-part and the second elbow sub-part may include a hinge bore surrounded by a recess that is configured to receive either of a bolt head or a nut, to enable reversible insertion of the joining device. In another aspect, the first outer edge of the first concave surface and the second outer edge of the second concave surface may be rounded. In another aspect, when the first elbow sub-part is connected to the second elbow sub-part, the connecting portion of the first elbow sub-part may define a first radially outermost dimension of the elbow assembly on a first side of the longitudinal axis, and the connecting portion of the second elbow sub-part may define a second radially outermost dimension of the elbow assembly on a second side of the longitudinal axis that is opposite the first side, the guard portion of the first elbow sub-part may not project beyond the second radially outermost dimension of the second elbow sub-part on the second side of the longitudinal axis, and the guard portion of the second elbow sub-part may not project beyond the first radially outermost dimension of the first elbow sub-part on the first side of the longitudinal axis. In another aspect, for each of the first elbow sub-part and the second elbow sub-part, the arm portion may have a central bore extending therethrough, with the first interface surface located on a first side of the central bore and a second interface surface located on a second side of the central bore, the first interface surface being coplanar with the second interface surface, and when the first elbow sub-part is connected to the second elbow sub-part, the second interface surface of the first elbow sub-part may interface with the second interface surface of the second elbow sub-part. In another aspect, the base portion of the first elbow sub-part may have a first diameter and the base portion of the second elbow sub-part may have a second diameter, to facilitate connection between tubing members of different sizes. In another aspect, the first interface surface may be coplanar with the longitudinal axis. In another aspect, for each of the first elbow sub-part and the second elbow sub-part, the end surface of the arm portion may be rounded. In another aspect, when the first elbow sub-part is connected to the second elbow sub-part, the first concave surface of the first elbow sub-part may be configured to partially cover the rounded end of the second elbow sub-part when the second elbow sub-part contacts the first stop of the first elbow sub-part, and the second concave surface of the first elbow sub-part may be configured to partially cover the rounded end of the second elbow sub-part when the second elbow sub-part contacts the second stop of the first elbow sub-part. In another aspect, for each of the first elbow sub-part and the second elbow sub-part, the guard portion may form a peak where the first concave surface meets the second concave surface. In another aspect, when the first elbow sub-part is connected to the second elbow sub-part, a radially outermost surface of the peak of the first elbow sub-part may be coplanar with a radially outermost surface of the arm portion of the second elbow sub-part, and a radially outermost surface of the peak of the second elbow sub-part may be coplanar with a radially outermost surface of the arm portion of the first elbow sub-part, in order to provide a smooth transition between the first elbow sub-part and the second elbow sub-part at any angle within the range of motion. In another aspect, for each of the first elbow sub-part and the second elbow sub-part, the first concave surface may meet the second concave surface at a ridge that ends at the peak. In another aspect, an intermediate surface that is perpendicular or oblique relative to the longitudinal axis may be located at the intermediate position of the body.

In another aspect, the present disclosure provides a ramp and platform assembly that includes a platform section, a ramp section, a first support member, a second support member, and a first elbow assembly. The platform section has a walking surface. The ramp section has a first end and a second end, the first end being connected to the platform section. The first support member is supported by at least one of the platform section or the ramp section. The first elbow assembly connects the first support member to the second support member. The first elbow assembly includes a first elbow sub-part, a second elbow sub-part, and a body. The first elbow sub-part and the second elbow sub-part are selectably and hingeably connectable to each other by a joining device. The body defines a distal end, a proximal end, and a longitudinal axis extending therethrough, and has a base portion and a connecting portion. The base portion extends from the distal end to an intermediate position located between the distal end and the proximal end, and is configured for insertion into a tubing member. The connecting portion extends from the intermediate position to the proximal end, and has an arm portion and a guard portion. The arm portion extends to an end surface at the proximal end and has a first interface surface that is parallel to the longitudinal axis, and the guard portion has a first concave surface and a second concave surface that are oriented toward the arm portion. A first outer edge of the first concave surface meets the arm portion at a first stop, and a second outer edge of the second concave surface meets the arm portion at a second stop. The first elbow sub-part is connected to the second elbow sub-part, the second elbow sub-part is configured to pivot relative to the first elbow sub-part within a range of motion between the first stop and the second stop, the first interface surface of the first elbow sub-part interfaces with the first interface surface of the second elbow sub-part, the end surface of the first elbow sub-part nests between the first interface surface and at least one of the first concave surface or the second concave surface of the second elbow sub-part, and the end surface of the second elbow sub-part nests between the first interface surface and at least one the first concave surface or the second concave surface of the first elbow sub-part. The base portion of the first elbow sub-part is joined with the first support member and the base portion of the second elbow sub-part is joined with the second support member.

In another aspect of the ramp and platform assembly, the base portion of the first elbow sub-part may be inserted into a tubing portion of the first support member and the base portion of the second elbow sub-part may be inserted into a tubing portion of the second support member. In another aspect, for each of the first elbow sub-part and the second elbow sub-part, the arm portion may have a central bore extending therethrough, with the first interface surface located on a first side of the central bore and a second interface surface located on a second side of the central bore, with the first interface surface being coplanar with the second interface surface, and with the second interface surface of the first elbow sub-part interfacing with the second interface surface of the second elbow sub-part. In another aspect, for each of the first elbow sub-part and the second elbow sub-part, the guard portion may form a peak where the first concave surface meets the second concave surface. In another aspect, the base portion of the first elbow sub-part may be attached directly to a flat portion of the first support member via a joining member that extends through a central bore of the base portion and through the flat portion of the first support member, and the base portion of the second elbow sub-part may be inserted into a tubing portion of the second support member. In another aspect, the elbow sub-part may be configured to selectably and hingeably connect to a second elbow sub-part.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
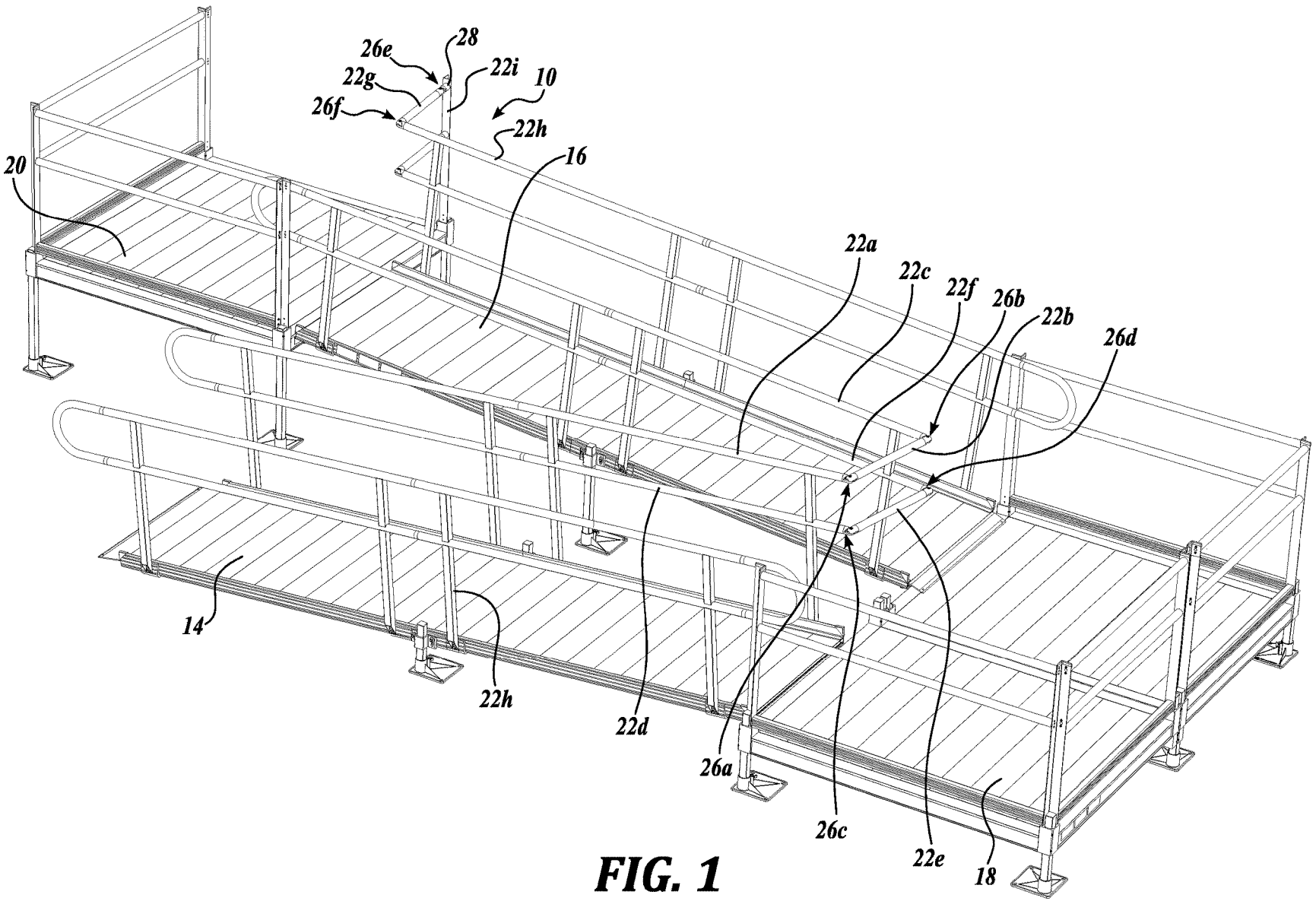
FIG. 1 is an isometric view of a ramp and platform assembly including a plurality of elbow assemblies in accordance with embodiments of the present disclosure.
Figure 2A:
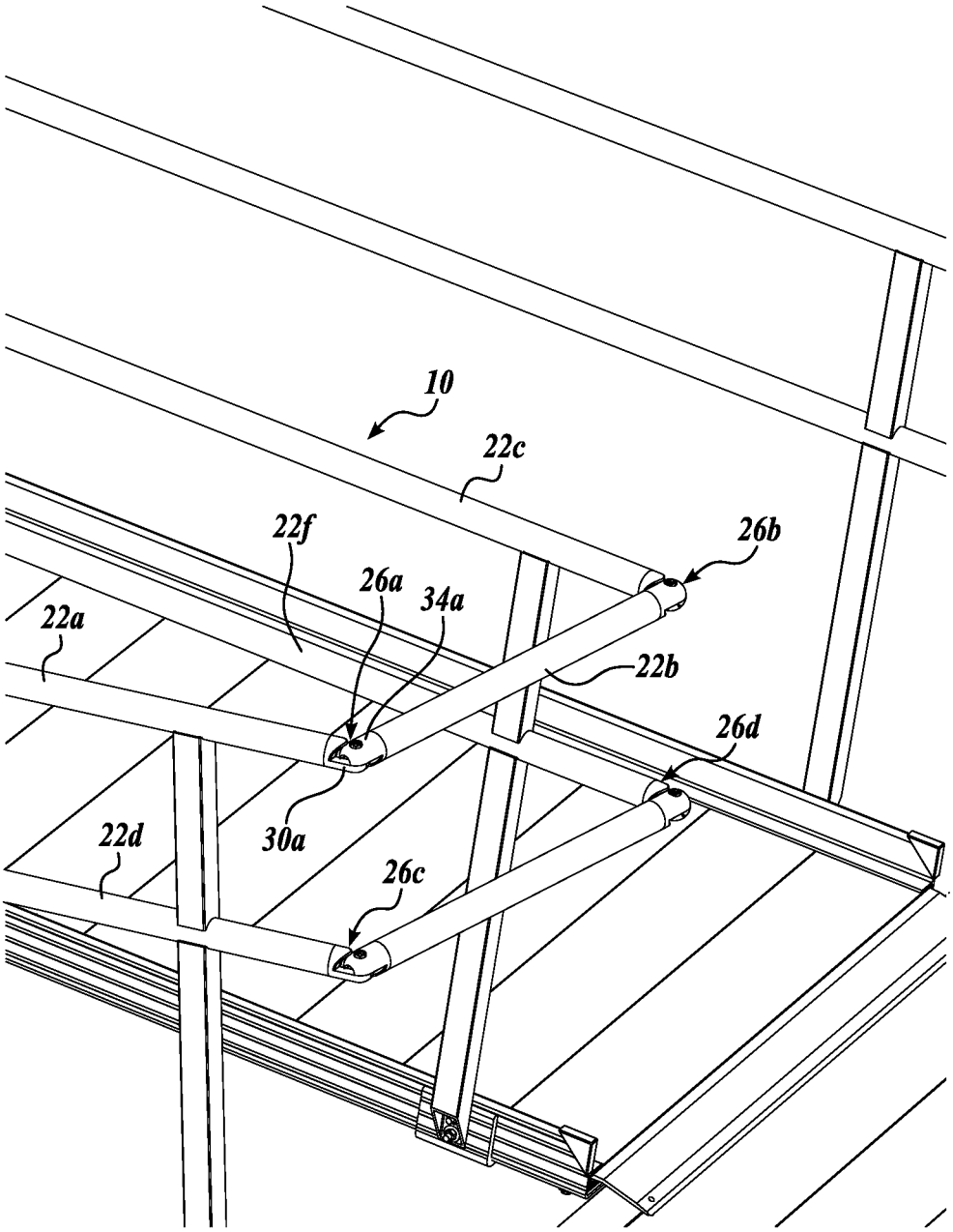
FIG. 2A is a close-up, isometric view of a handrail assembly of the ramp and platform assembly of FIG. 1.
Figure 2B:
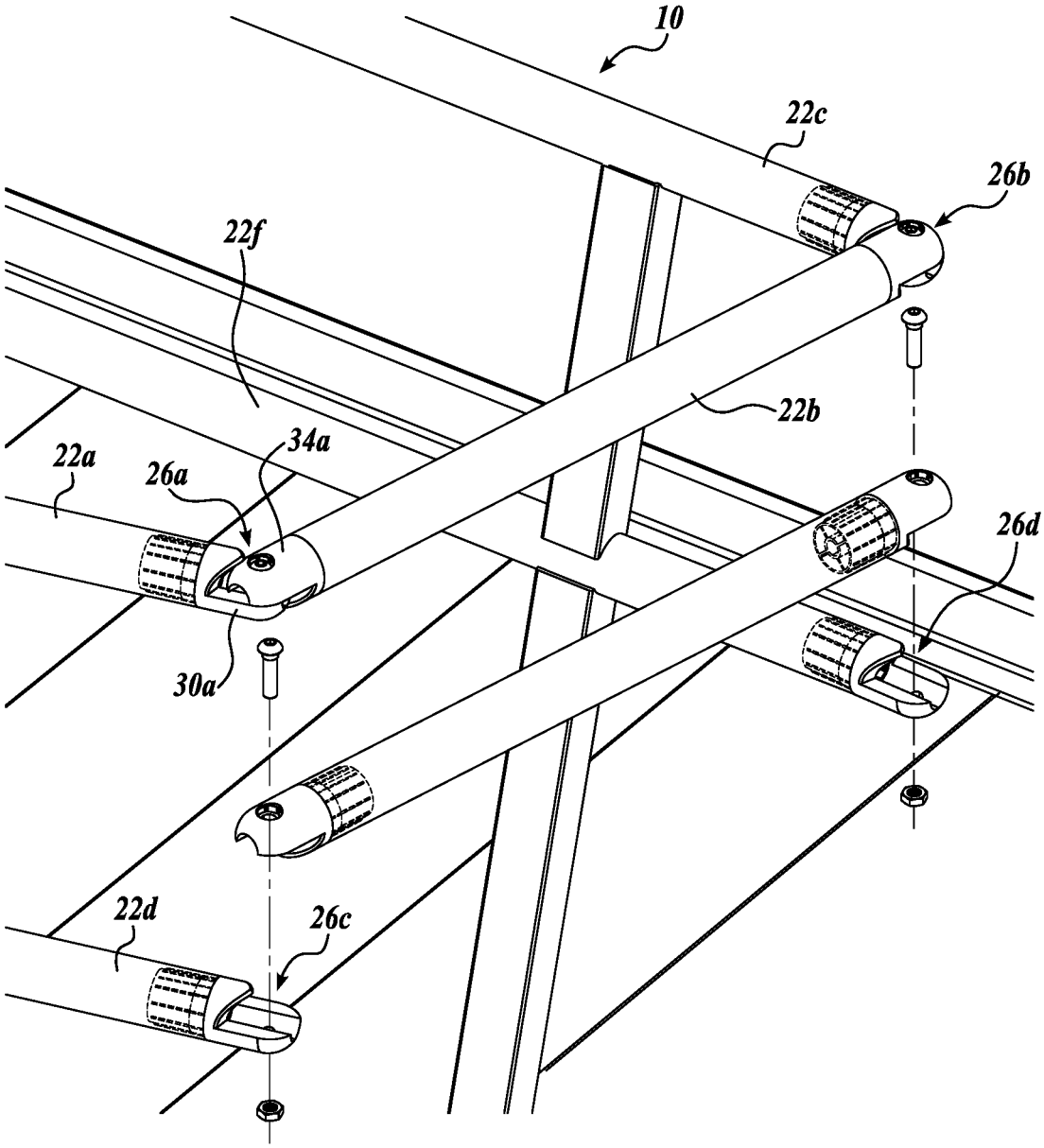
FIG. 2B is a partially exploded view of the handrail assembly of the ramp and platform assembly shown in FIG. 2A.

Embodiments of the present disclosure are generally directed to elbow assemblies, for example, for use in connecting components of handrail assemblies that may be used in ramp and platform assemblies, for example as can be seen in FIGS. 1, 2A, and 2B. Although shown and described in relation to a handrail connector assembly and a ramp and platform assembly, it should be appreciated that other types of uses for elbow assemblies are also within the scope of the present disclosure, such as connecting any two support members (e.g., handrails).

Elbow assemblies of the present disclosure have versatility in that they may be used to connect two tubular handrails requiring adjustability in a pivot axis as well as an axial axis. In an alternate configuration, the elbow assembly may connect a tubular handrail to a flat portion of a support member, such as a post, a flat handrail, or other flat piece (e.g., a piece of angle aluminum). The elbow assemblies described herein can be installed without holes, fasteners, or modifications to the support members that are being joined, and therefore both the elbow assemblies and the support members can be reused or rejoined repeatedly. Further, it should be appreciated that elbow assemblies described herein may be sized and/or shaped to accommodate various different support members.

FIG. 1 shows an exemplary ramp and platform assembly 10, such as may be used to provide an access solution between two or more different elevations. The ramp and platform assembly 10 includes a plurality of ramps 14, 16 and a plurality of platforms 18, 20. Ramp 14 rests upon a ground surface and connects to platform 18, which has a first elevation. Ramp 16 connects platform 18 to platform 20, which has a second elevation. Thus, the ramp and platform assembly 10 provides a ramped access solution between a ground surface and the second elevation. The illustrated embodiment is merely exemplary. In some embodiments, the ramp and platform assembly 10 may include fewer or more numerous ramps and platforms (which may have different dimensions, inclines, and/or elevations than shown in FIG. 1).

Many of the components of the ramp and platform assembly 10 may be formed from metal, for example, from extruded aluminum. Extruded aluminum construction generally reduces parts in the overall system, thereby reducing manufacturing and assembly costs, as well as operational noise generated by rattling part couplings. Moreover, extruded aluminum parts can be designed to achieve the same strength and stiffness requirements as steel construction, while having reduced weight over steel parts or parts made from other materials, allowing for improved ease of assembly and optimized part design. In some embodiments, one or more components of the ramp and platform assembly 10 may be formed from another material, e.g., an injection molded polymer.

The ramp and platform assembly includes a plurality of support members 22, such as support members 22*a*-22*j*. Support members 22 generally provide a stable handhold, post, or guide for users of the ramp and platform assembly 10. In the illustrated embodiment, support members 22*a*-22*h* are tubular metal handrails. Support members 22*i* and 22*j* are vertical pickets. The shapes, materials, and dimensions of support members 22*a*-22*j* are exemplary. Other support members are contemplated (e.g., rectangular tubing, flat pieces of steel or aluminum).

The ramp and platform assembly includes a plurality of elbow assemblies 26, such as elbow assemblies 26*a*-26*f*. Each elbow assembly 26 is adjustable and generally connects two support members 22 at an angle; however, each elbow assembly 26 may connect two support members in a straight line (see FIG. 7). Each elbow assembly 26 provides a transition between support members 22. In addition, the elbow assemblies 26 help to strengthen the ramp and platform assembly 10 by distributing forces applied to one support member 22 to another (e.g., distributing a force applied directly to support member 22*b* to adjacent support members 22*a* and 22*c*). The elbow assemblies 26 of FIG. 1 are illustrated as connecting handrails in FIGS. 1-2B, but may also be configured to connect pickets to handrails, and to connect other types of support members.

FIGS. 2A and 2B show a detail view and a partial exploded view, respectively, of a portion of the ramp and platform assembly 10 of FIG. 1. Elbow assembly 26*a* includes a first elbow sub-part 30*a* that is pivotably joined with a second elbow sub-part 34*a*. As shown, the elbow assembly 26*a* connects tubular portions of support members 22*a* and 22*b* at an obtuse angle (see also FIG. 3). Similarly, elbow assembly 26*b* connects tubular portions of support members 22*b* and 22*c* at approximately a right angle. Similar to elbow assemblies 26*a* and 26*b*, respectively, elbow assembly 26*c* connects tubular support members 22*d* and 22*e*, while elbow assembly 26*d* connects tubular support members 22*e* and 22*f*. Elbow assemblies 26*c* and 26*d* are exploded in FIG. 2B to facilitate understanding of the interrelationship between the first and second elbow sub-parts. Elbow assemblies designed and configured in accordance with embodiments of the present disclosure may also be configurable to connect two support members at an acute angle (see FIG. 4).

Figure 2C:
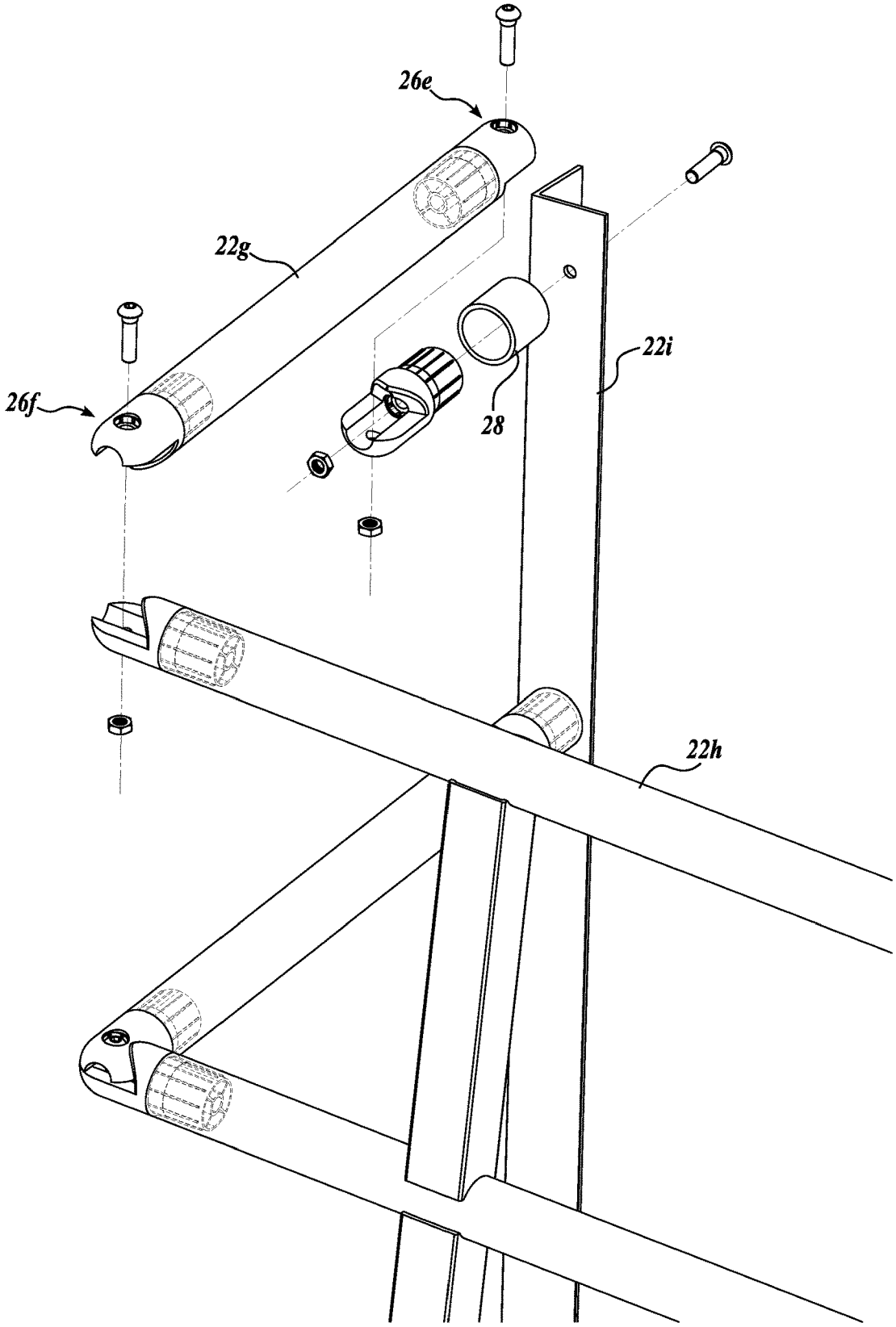
FIG. 2C is partially exploded view of another aspect of the handrail assembly of the ramp and platform assembly shown in FIG. 2A.

FIG. 2C shows a partial exploded view of another portion of the ramp and platform assembly 10 of FIG. 1. Advantageously, elbow assemblies of the present disclosure are convertible between a first configuration that connects two tubular support members (in the manner of elbow assembly 26F) and also a second configuration that connects a tubular portion of a first support member to a flat portion of second support member. In both configurations, the elbow assembly retains its full range of motion. Elbow assembly 26*e* exemplifies the second configuration, as it directly connects support member 22*i* (a vertical section of angle metal) to tubular support member 22*g*. This configuration is enabled by fastening a base portion of the elbow assembly 26*e* to the support member 22*i* with a bolt that extends through a central bore through the base portion, with the bolt being secured to the flat support member 22*i* by a nut. The bolt and nut are exemplary joining members that may be used for this purpose, but other joining members are contemplated. Further, the bolt and nut may be reversed, e.g. for easier installation. Further still, an optional sleeve 28 may cover the otherwise visible ribs of the base portion of the elbow assembly 26*e*. The structural details of the elbow assembly are described below.

In another configuration (shown in FIGS. 16-17B), an elbow assembly 26*g* of the present disclosure connects a tubular support member 22*d* to a flat portion of another support member 22*j* in a second manner. To enable this connection, the elbow assembly 26*g* includes only a first elbow sub-part (described below), which is bolted directly to the flat portion of support member 22*j*.

FIGS. 3-7 illustrate detailed views of an exemplary elbow assembly 26, which is representative of any of elbow assemblies 26*a-f* shown in FIGS. 1-2C in various different views and configurations. For this reason, reference numerals are generally consistent for like part numbers in FIGS. 1-2C and FIGS. 3-7. The elbow assembly 26 includes a first elbow sub-part 30 that is hingedly joined with a second elbow sub-part 34 by a joining device 38. In the illustrated embodiment, the joining device 38 is a nut and bolt assembly. In other embodiments, the joining device 38 may be a quick release pin or another suitable joining device. The first elbow sub-part 30 and the second elbow sub-part 34 are configured such that the joining device 38 is reversibly inserted through the sub-parts 30 and 34 for ease of assembly.

Figure 3:
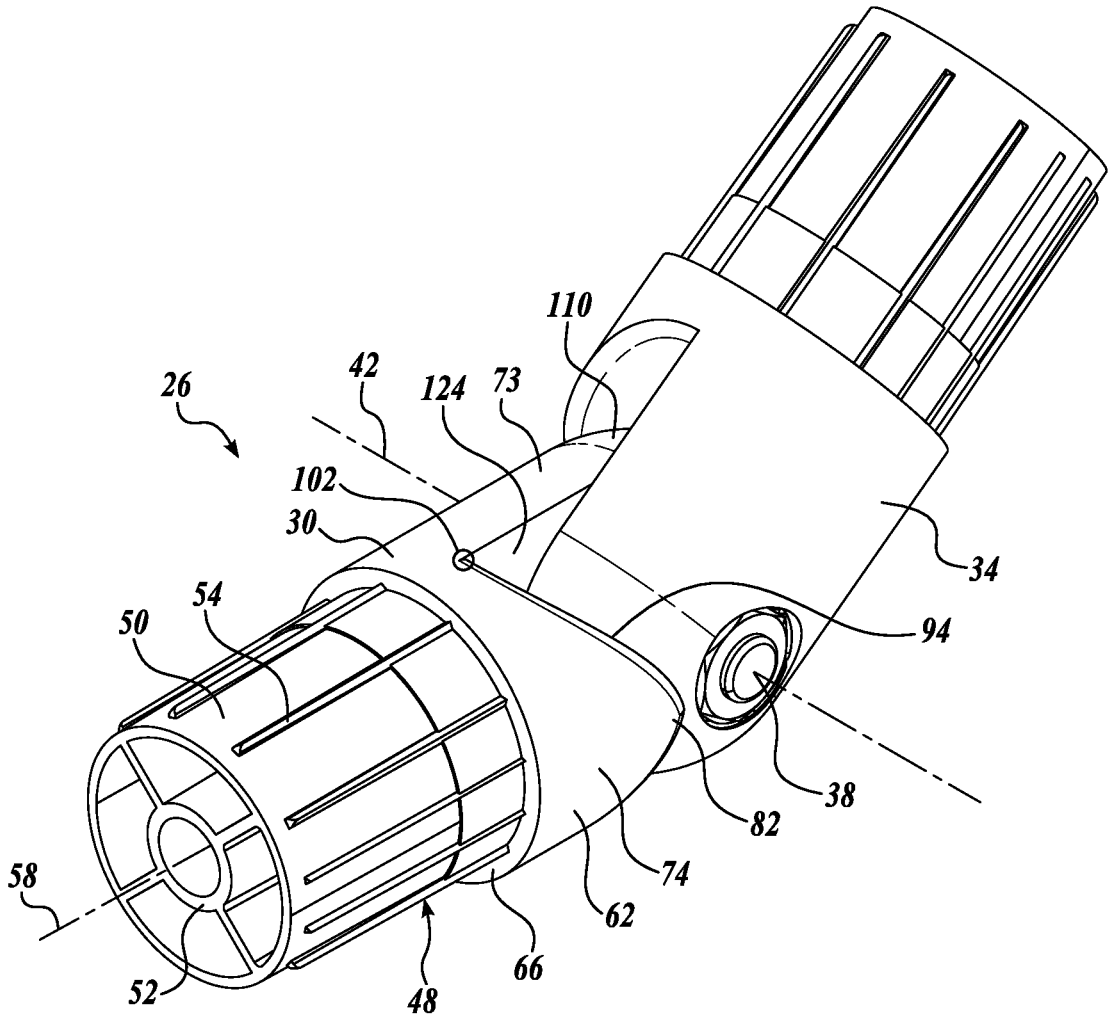
FIG. 3 is an isometric view of an elbow assembly of the ramp and platform assembly of FIG. 1 in accordance with an embodiment of the present disclosure.
Figure 4:
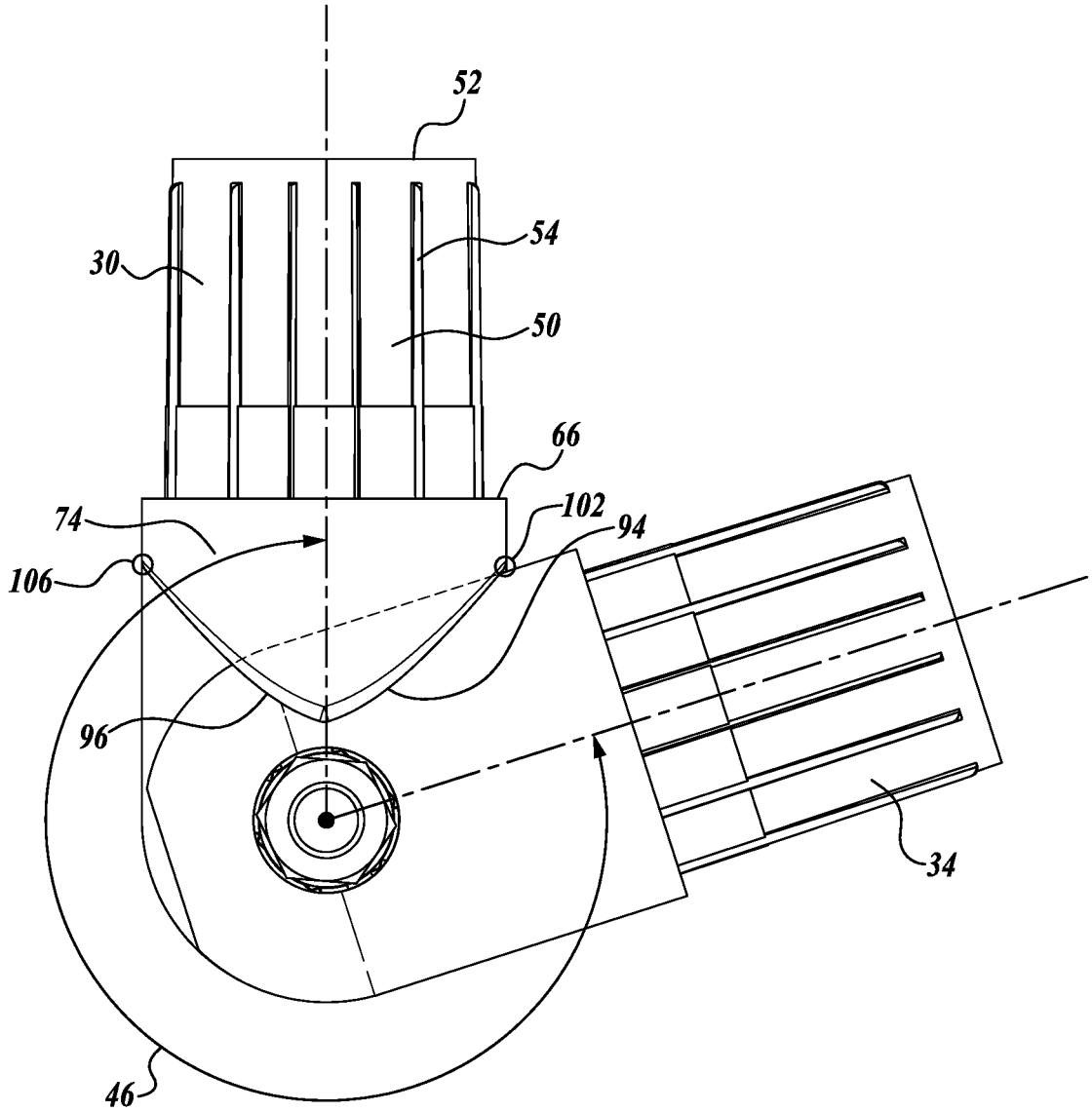
FIG. 4 is a side view of the elbow assembly of FIG. 3, but in another orientation.

The first elbow sub-part 30 and the second elbow sub-part 34 may move relative to each other about the joining device 38 within a range of motion, as indicated by arrow 46 in FIG. 4. Due to the shape and dimensions of the first elbow sub-part 30 and the second elbow sub-part 34 as will be described below, the range of motion 46 of the joining device 38 exceeds 180 degrees (e.g., about 220 degrees, about 250 degrees, about 270 degrees, about 280 degrees, about 290 degrees, about 300 degrees, etc.). This range of motion enables the elbow assembly 26 to join two support elements at various acute angles, at a right angle, in a straight line (see FIG. 7), and at various obtuse angles (see, e.g., FIG. 3), thereby enabling a great number of assembly configurations.

The first elbow sub-part 30 and the second elbow sub-part 34 have like features, and for ease of communication the features are generally described below with respect to the first elbow sub-part 30, except where necessary to describe features with respect to both the first elbow sub-part 30 and the second elbow sub-part 34. In some embodiments, the first elbow sub-part 30 and the second elbow sub-part 34 are mirror images of each other. It shall be understood that the second elbow sub-part 34 has similar features as the first elbow sub-part 30 except where expressly stated.

Figure 5:
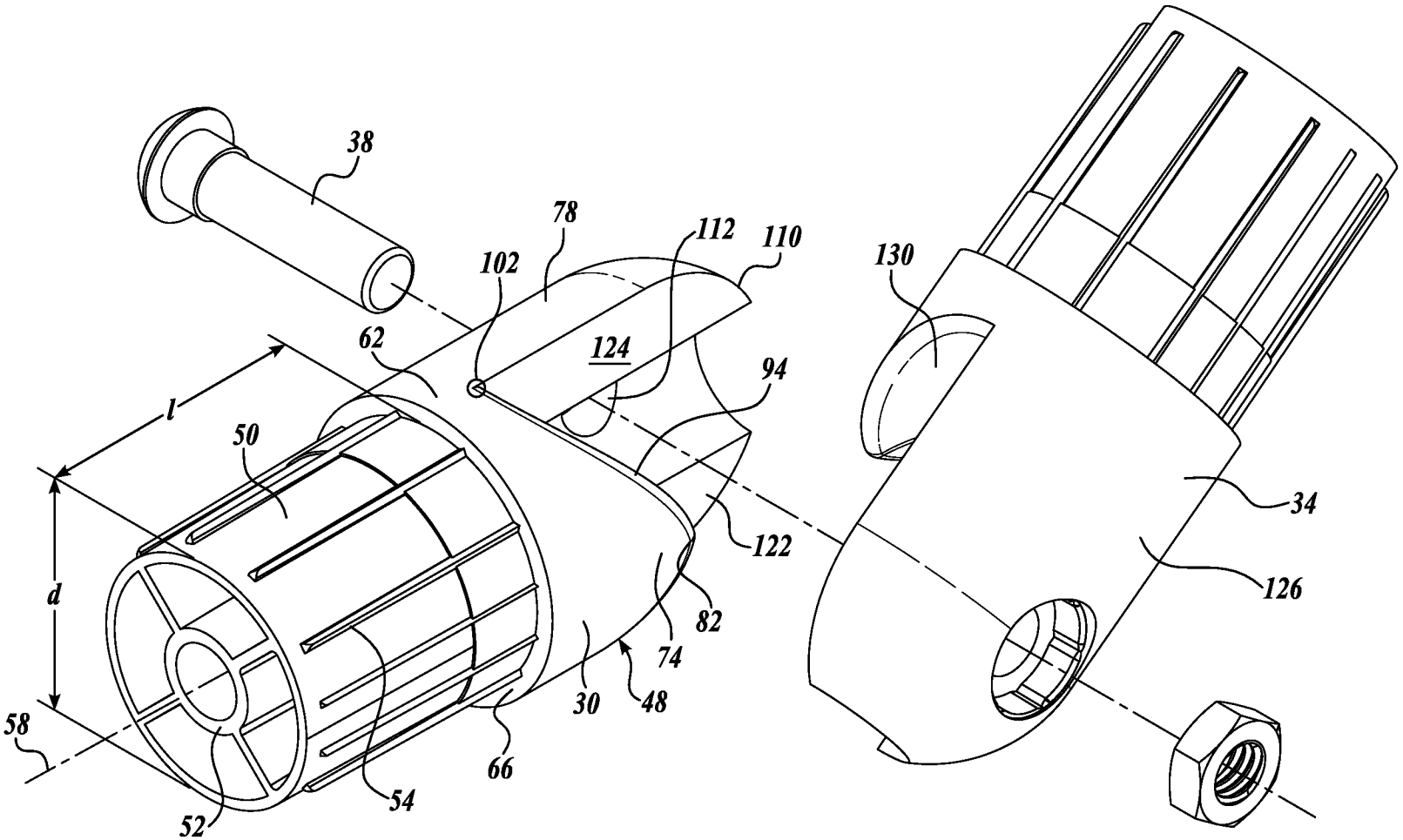
FIG. 5 is an exploded view of the elbow assembly of FIG. 3.

As best viewed in FIG. 5, the first elbow sub-part 30 has a body 48 defining a base portion 50 that extends between a distal end 52 and a connecting portion 62, and is configured to slidably engage a tubular support member. The base portion 50 has a length l that may vary in different embodiments, e.g., between about 1-6 inches. The base portion 50 has a diameter d of between about 1-6 inches. The diameter d of the base portion 50 indicates the smallest (internal) diameter tubular support member (e.g., support member 22*a* in FIGS. 2A and 2B) that first elbow sub-part 30 may attach to. The base portion 50 includes a plurality of protrusions 54 that extend radially away from a longitudinal axis 58 and are configured to create a friction fit with an interior surface of a tubular support member (e.g., support member 22*a*). The base portion 50 has a generally circular cross section having a center longitudinal axis 58. The radially outermost surfaces of the protrusions 54 generally correspond to the limits of diameter d.

Although the elbow assembly 26 is illustrated in FIGS. 3-7 as having a base portion 50 having a circular cross-section, the base portion 50 may also be configured as having a cross-section of another shape to be received within a tubular support member having the same shape. As not limiting examples, the cross-section of the base portion may be square, rectangular, oval, polygonal, or any other corresponding shape. In these different shapes, the base portion still may be configured to include protrusions for a friction fit with an interior surface of the receiving tubular support member.

The base portion 50 of the first elbow sub-part 30 is adjacent a connecting portion 62, which abuts the base portion 50 and is configured to extend beyond the tubular support member 22*a* when the base portion 50 is engaged therewith. The connecting portion 62 is configured to interchangeably attach either to the second elbow sub-part 34 or to another support member (e.g., support member 22*a* in FIGS. 2A and 2B). In use, the base portion 50 is inserted into a tubular support member (e.g., up to a stopper face 66, which is located at an intermediate position along body 48), and the connecting portion 62 extends away from the tubular support member. At least part of the connecting portion 62 may have an outer diameter that is calculated to create a flush transition between the support member and the connecting portion 62 of the first elbow sub-part 30 when the two are joined.

Figure 6:
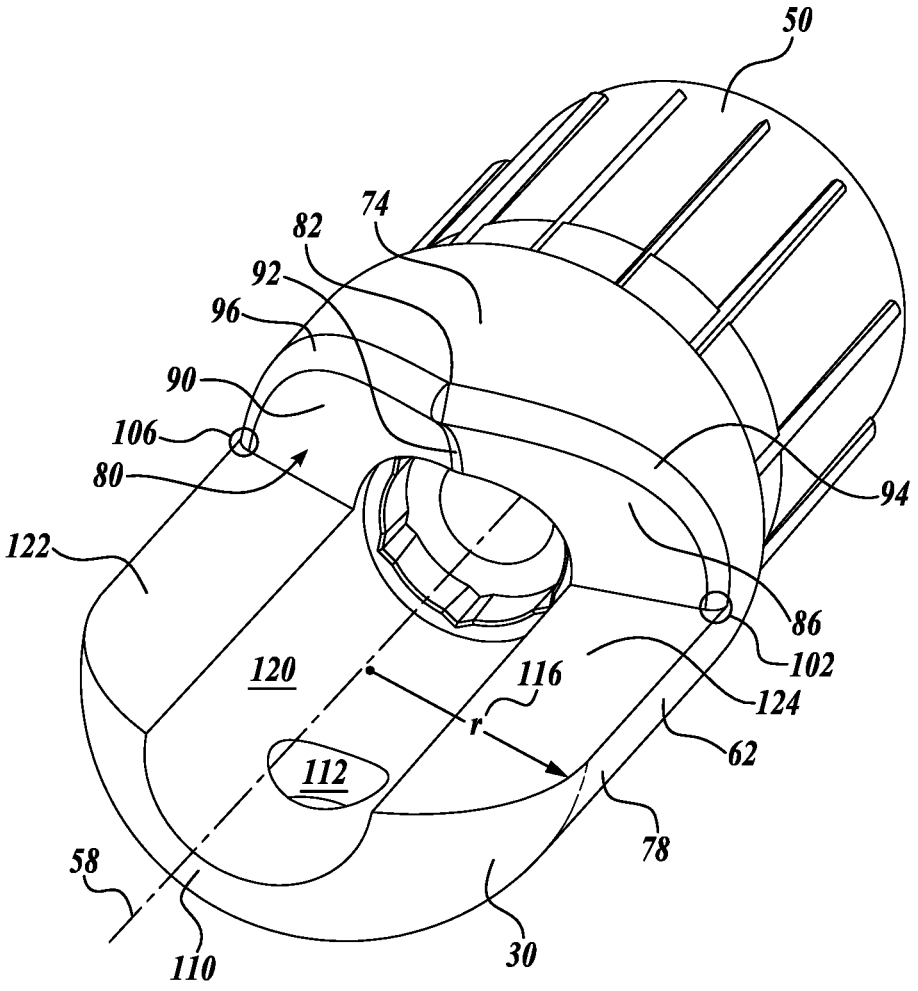
FIG. 6 is a view of a component of the elbow assembly of FIG. 3.

The connecting portion 62 of the first elbow sub-part 30 includes a guard portion 74 and an arm portion 78. As seen in FIG. 6, the guard portion 74 and the arm portion 78 of the first elbow sub-part 30 form a shelf 80 that sized to align with the second elbow sub-part 34 when it is coupled with the first elbow sub-part 30 (see first and second sub-parts 30 and 34 coupled in FIG. 3), such that the second elbow sub-part 34 nests between the guard portion 74 and the arm portion 78 of the first elbow sub-part 30, and vice versa. In this way, the guard portion 74 of the first elbow sub-part 30 forms a guard over the second elbow sub-part 34 to achieve a smooth transition for the user navigating the handrail connection at the elbow assembly 26. The guard portion 74 of the second elbow sub-part 34 forms a reciprocal guard over the first elbow sub-part 30 to likewise achieve a smooth transition for the user navigating the handrail connection at the elbow assembly 26.

Referring to FIG. 6, the shelf 80 formed by the guard portion 74 is contoured. In the illustrated embodiment, the guard portion 74 has a peak 82 where a first concave surface 86 abuts a second concave surface 90. The first concave surface 86 and the second concave surface 90 each have an internal size and shape that is designed to accommodate the pivoting end of an arm portion of the second elbow sub-part 34, described below. The first concave surface 86 meets the second concave surface 90 at a central ridge 92. The first concave surface has a first rounded edge 94 to improve user comfort and to increase safety. Similarly, the second concave surface has a second rounded edge 96. The first concave surface 86 terminates in a first stop 102, and the second concave surface 90 terminates in a second stop 106. In some embodiments, the first stop 102 and/or the second stop 106 may be configured, to increase or decrease the pivoting range of motion of the elbow assembly 26.

Figure 7:
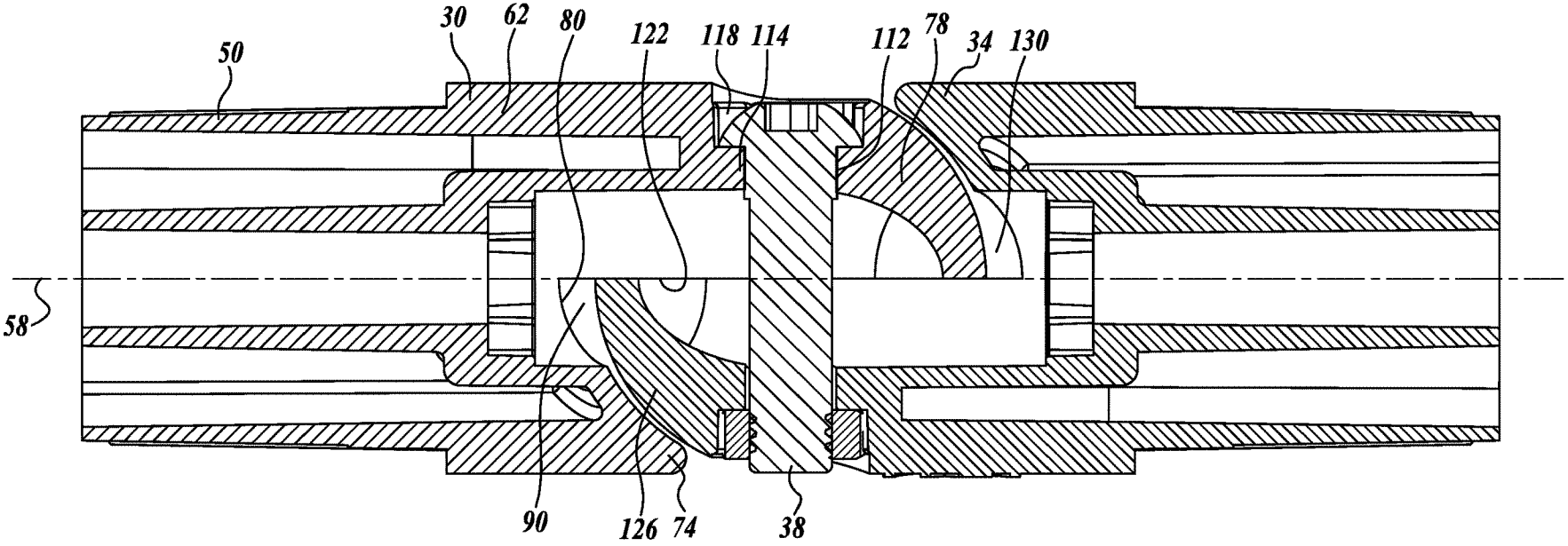
FIG. 7 is a section view of the elbow assembly of FIG. 3.
Figure 8:
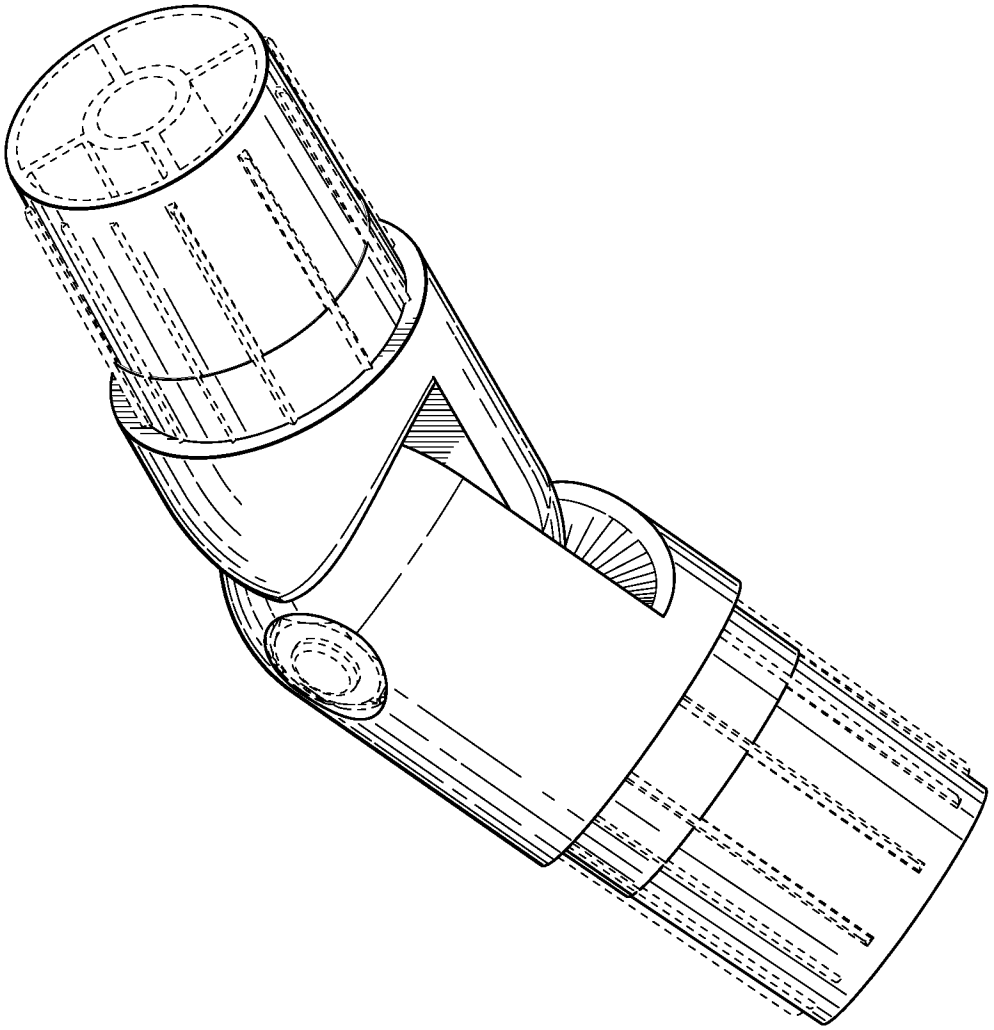
FIG. 8 is another isometric view of the elbow assembly of FIG. 3, shown with shading to clarify certain surfaces.
Figure 9:
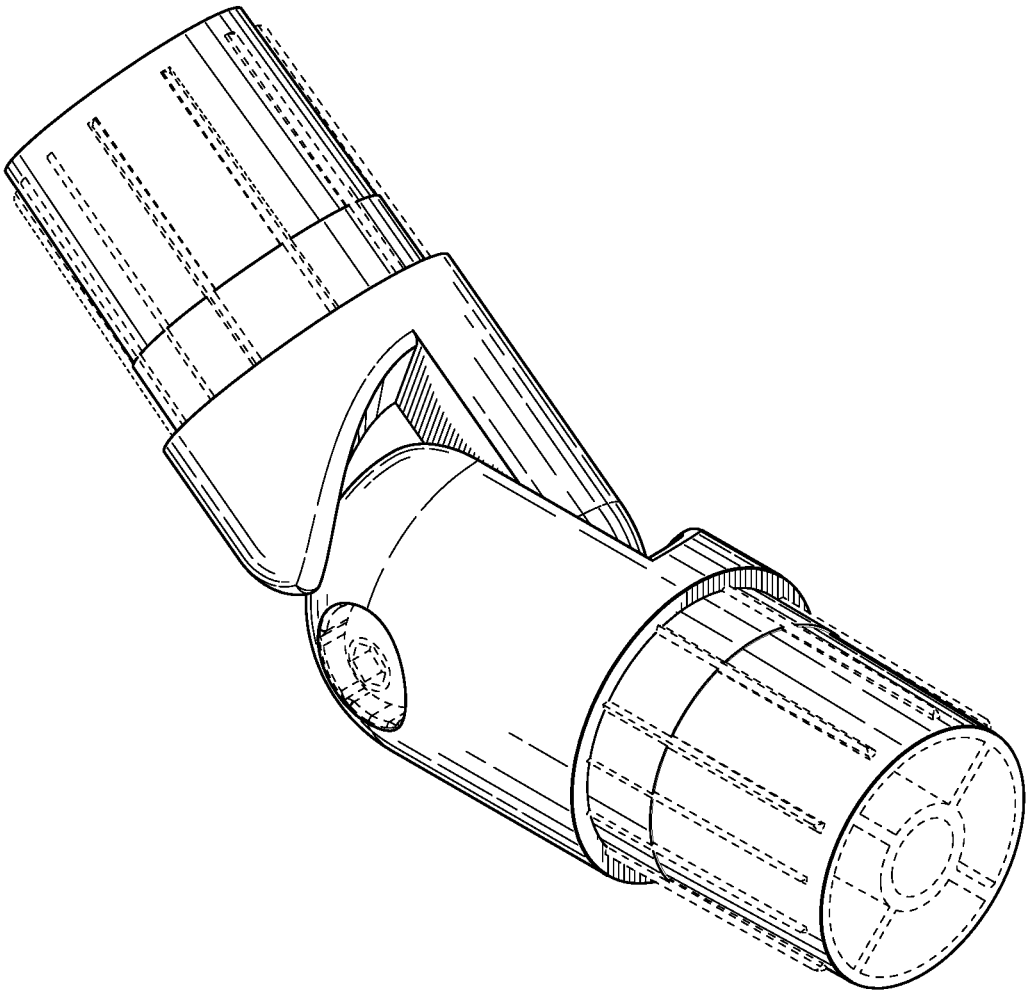
FIG. 9 is another isometric view of the elbow assembly of FIG. 3, shown with shading to clarify certain surfaces.
Figure 10:
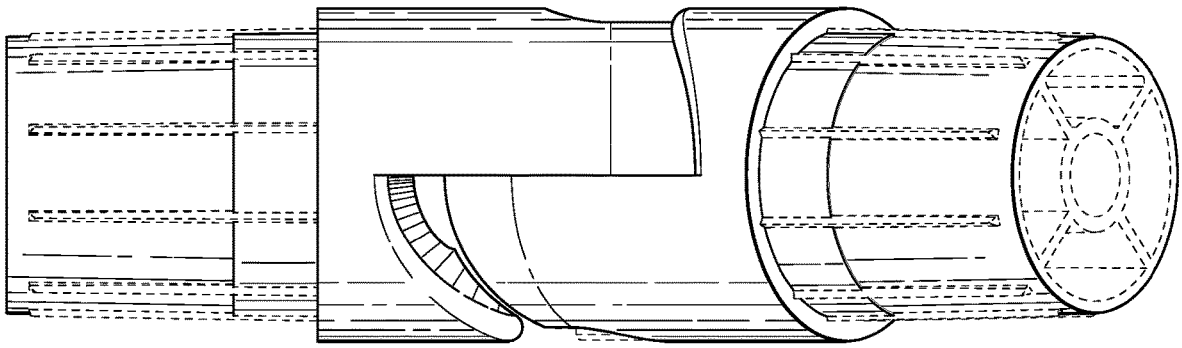
FIG. 10 is a top view of the elbow assembly of FIG. 3, shown with shading to clarify certain surfaces.
Figure 11:
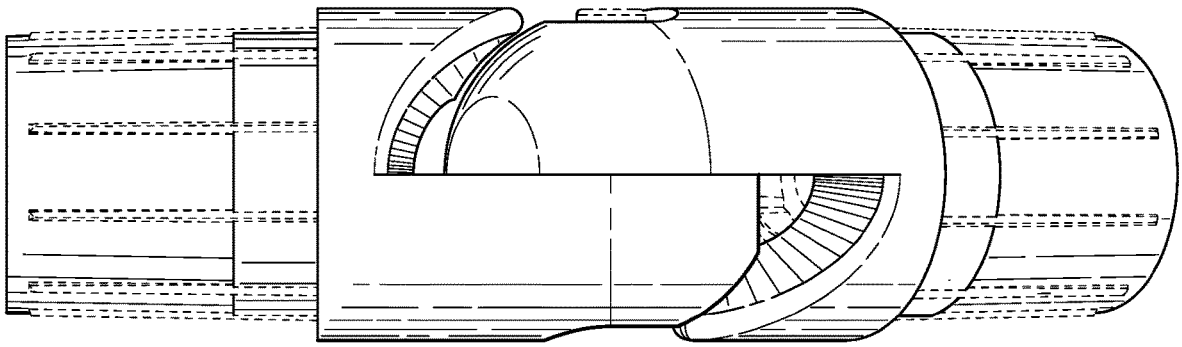
FIG. 11 is a bottom view of the elbow assembly of FIG. 3, shown with shading to clarify certain surfaces.
Figure 12:
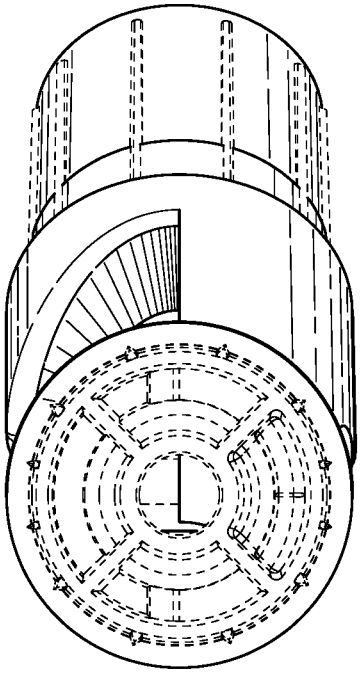
FIG. 12 is a front view of the elbow assembly of FIG. 3, shown with shading to clarify certain surfaces.
Figure 13:
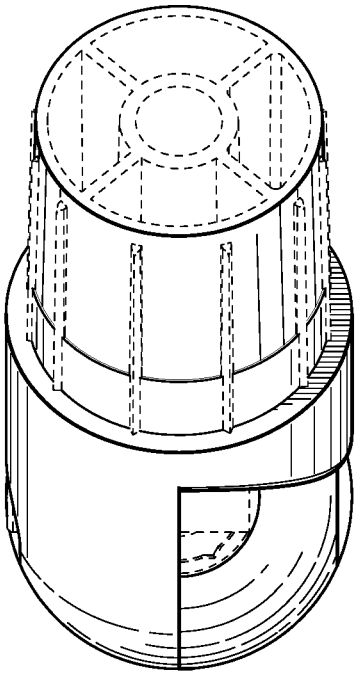
FIG. 13 is a rear view of the elbow assembly of FIG. 3, shown with shading to clarify certain surfaces.
Figure 14:
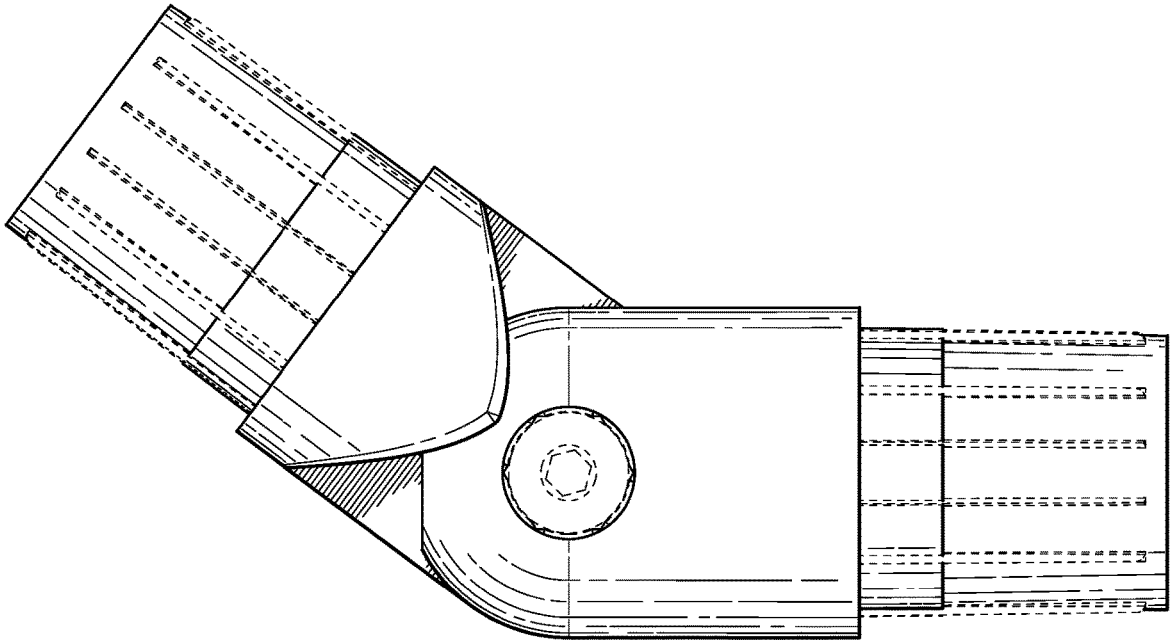
FIG. 14 is a left view of the elbow assembly of FIG. 3, shown with shading to clarify certain surfaces.
Figure 15:
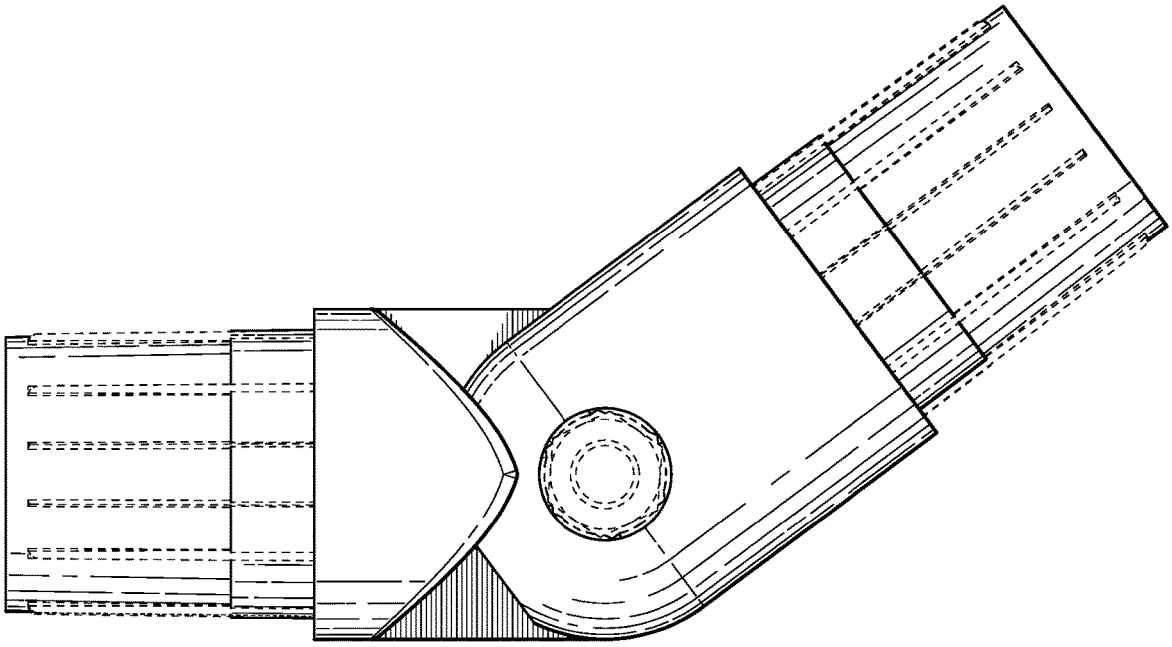
FIG. 15 is a right view of the elbow assembly of FIG. 3, shown with shading to clarify certain surfaces.

Referring still to FIG. 6, the arm portion 78 extends parallel to the longitudinal axis 58 and terminates at a proximal end 110, which has a surface that may be rounded (e.g., partially spherical) or have another shape. A hinge bore 112 extends through the arm portion 78 to receive the joining device 38 (shown in FIG. 5). In some embodiments, the hinge bore 112 may be configured to increase or decrease the pivoting range of motion 46 of the elbow assembly 26 (see FIG. 4). As shown in FIG. 7, a flange 114 surrounds the hinge bore 112 in order to prevent the joining device 38 from passing all the way through. A recess 118 surrounding the flange 114 may have a size and shape that is complementary to a bolt head and/or to a nut. In this way, the recess 118 can receive either a countersunk bolt head or a nut, giving the user greater flexibility to install the joining device 38 from either side of the elbow assembly 26.

As shown in FIG. 6, the proximal end 110 of the first elbow sub-part 30 has a partial spherical shape with an end radius r. Such a shape at the proximal end 110 allows for a cooperative fit with the shelf 80 of the second elbow sub-part 34, as can be seen in FIGS. 3 and 4. The partial spherical shape also provides a smooth transition for the user when the elbow assembly 26 connects two support members.

FIG. 6 illustrates a central bore 120 that extends in the direction of the longitudinal axis 58, to facilitate manufacturing and assembly, to reduce weight, and/or to reduce friction between the first elbow sub-part 30 and the second elbow sub-part 34. In the region of the arm portion 78, the central bore 120 may have a first diameter. The central bore 120 may have one or more different diameters at different points along the longitudinal axis 58. Some embodiments may not have a central bore 120 or may have a partial bore 120. The central bore 120 is configured to receive a joining member therethrough (e.g., a nut and/or bolt), to enable connection of the first elbow sub-part 30 to a flat portion of a support member (as shown with respect to elbow assembly 26*e* in FIG. 2C). Accordingly, the central bore 120 may have one or more recesses or other features (e.g., sizes and shapes) that are selected to receive a bolt head, a nut, or other joining member structure. The central bore 120 may be configured to receive an expander (not shown) to enhance the friction fit between the base portion 50 of the elbow sub-part 30 or 34 and the receiving end of the support member 22*a* (see FIGS. 2A and 2B).

Referring still to FIG. 6, a first interface surface 122 and a second interface surface 124 are positioned on opposite sides of the central bore 120. In embodiments with no central bore or with a partial bore, the interface surface may be a continuous surface. As seen in FIG. 3, when the first elbow sub-part 30 is joined with the second elbow sub-part 34, the first interface surface 122 and the second interface surface 124 each interface with opposing surfaces of the second elbow sub-part 34.

The first and second interface surfaces 122 and 124 form a planar surface. In applications in which the first elbow sub-part 30 is inserted into a tubular support member but is not joined with the second elbow sub-part 34, the first interface surface 122 and the second interface surface 124 are configured to interface directly with a support member (e.g., a flat support member, such as support member 22*j* in FIGS. 16-17B).

Referring to FIG. 7, when the first elbow sub-part 30 is joined with the second elbow sub-part 34 by the joining device 38, an arm portion 126 of the second elbow sub-part 34 (e.g., the proximal end 110 of the first elbow sub-part 30) nests between the first interface surface and at least one of the first concave surface or the second concave surface of the second elbow sub-part 34, and vice versa. In this way, the first elbow sub-part 30 and the second elbow sub-part 34 nest together.

Referring still to FIG. 7, the arm portion 126 of the second elbow sub-part 34 has a shape that is approximately complementary to the second concave surface 90 of the first elbow sub-part 30 (and the first concave surface 86, not shown in FIG. 7). For this reason, the first elbow sub-part 30 and the second elbow sub-part 34 can move relative to one another about the joining device 38. For example, referring to FIG. 4, the first elbow sub-part 30 and the second elbow sub-part 34 can move relative to each other within the range of motion 46 until the second elbow sub-part 34 makes contact with either the first stop 102 or the second stop 106 of the first elbow sub-part 30.

Referring still to FIG. 7, in the illustrated embodiment, the connecting portion 62 of the first elbow sub-part 30 defines an outermost dimension thereof on a first side of the longitudinal axis 58. To create a smooth transition between the first elbow sub-part 30 and the second elbow sub-part 34 at any angle within the range of motion 46, the guard portion 74 of the second elbow sub-part 34 does not project radially beyond the connecting portion 62 of the first elbow sub-part 30.

The elbow assembly 26 is adaptable to a wide variety of applications, given its wide range of motion 46 and convertability between configurations. In a first configuration, the first elbow sub-part 30 is coupled with the second elbow sub-part 34 via the joining device 38, as shown in FIG. 7. In use, the base portion 50 of the first elbow sub-part 30 may be inserted into a tubular portion of a first support member, and a base portion 50 of the second elbow sub-part 34 may be inserted into a tubular portion of a second support member at a different angle, such as shown with respect to elbow assembly 26*a* in FIGS. 1-2B.

Figure 16:
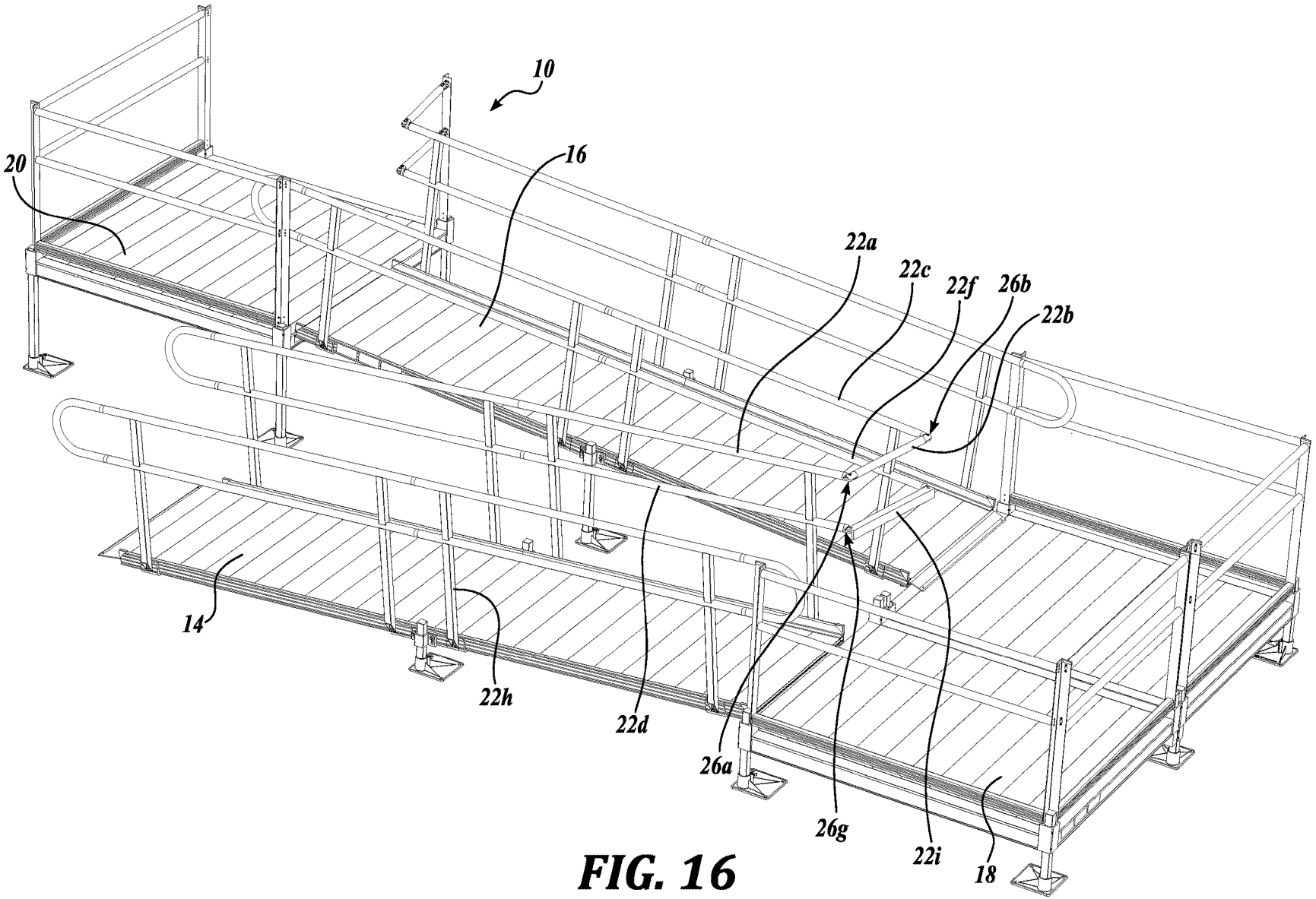
FIG. 16 is an isometric view of another ramp and platform assembly including a plurality of elbow assemblies in accordance with embodiments of the present disclosure.
Figure 17A:
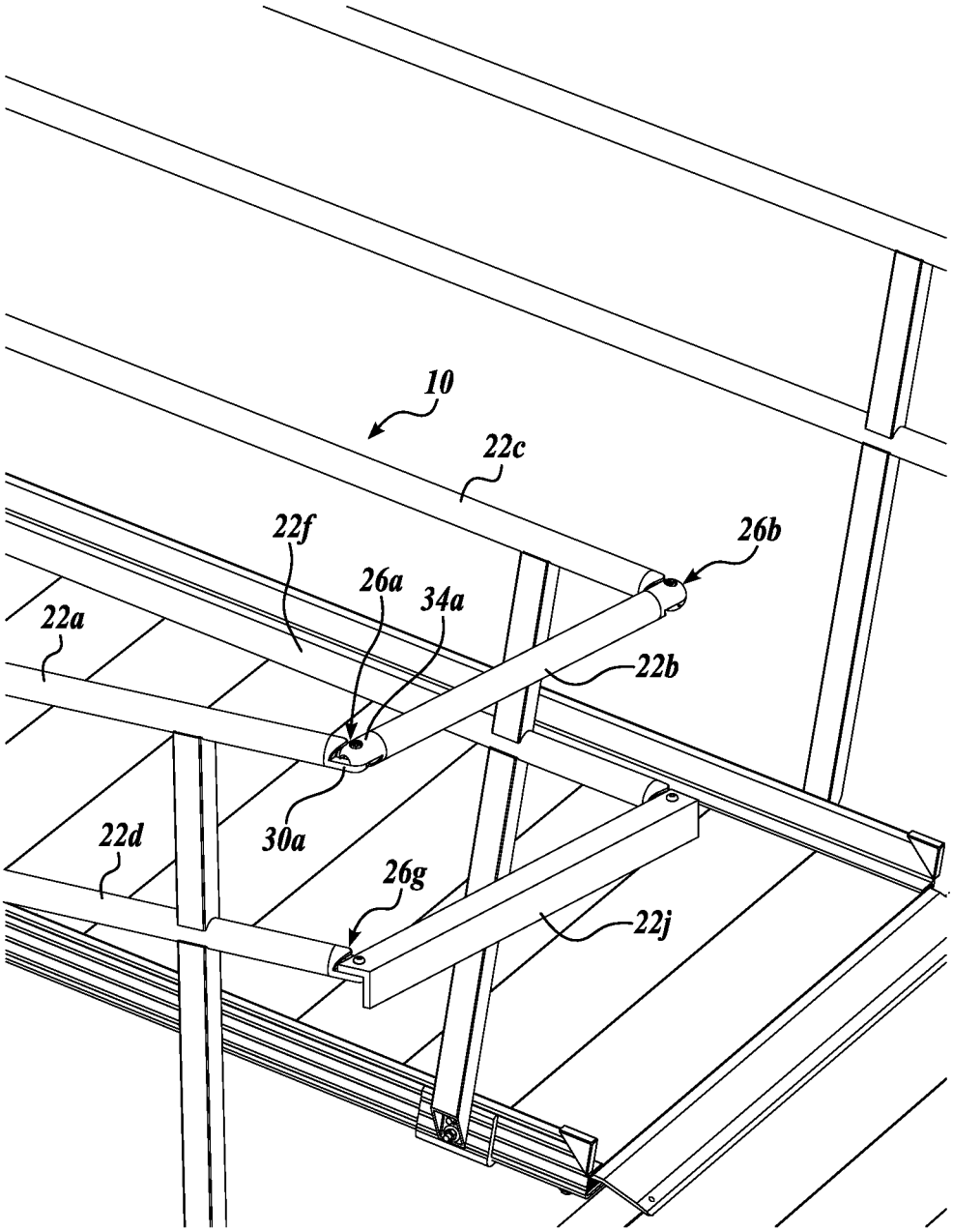
FIG. 17A is a close-up, isometric view of a handrail assembly of the ramp and platform assembly of FIG. 16.
Figure 17B:
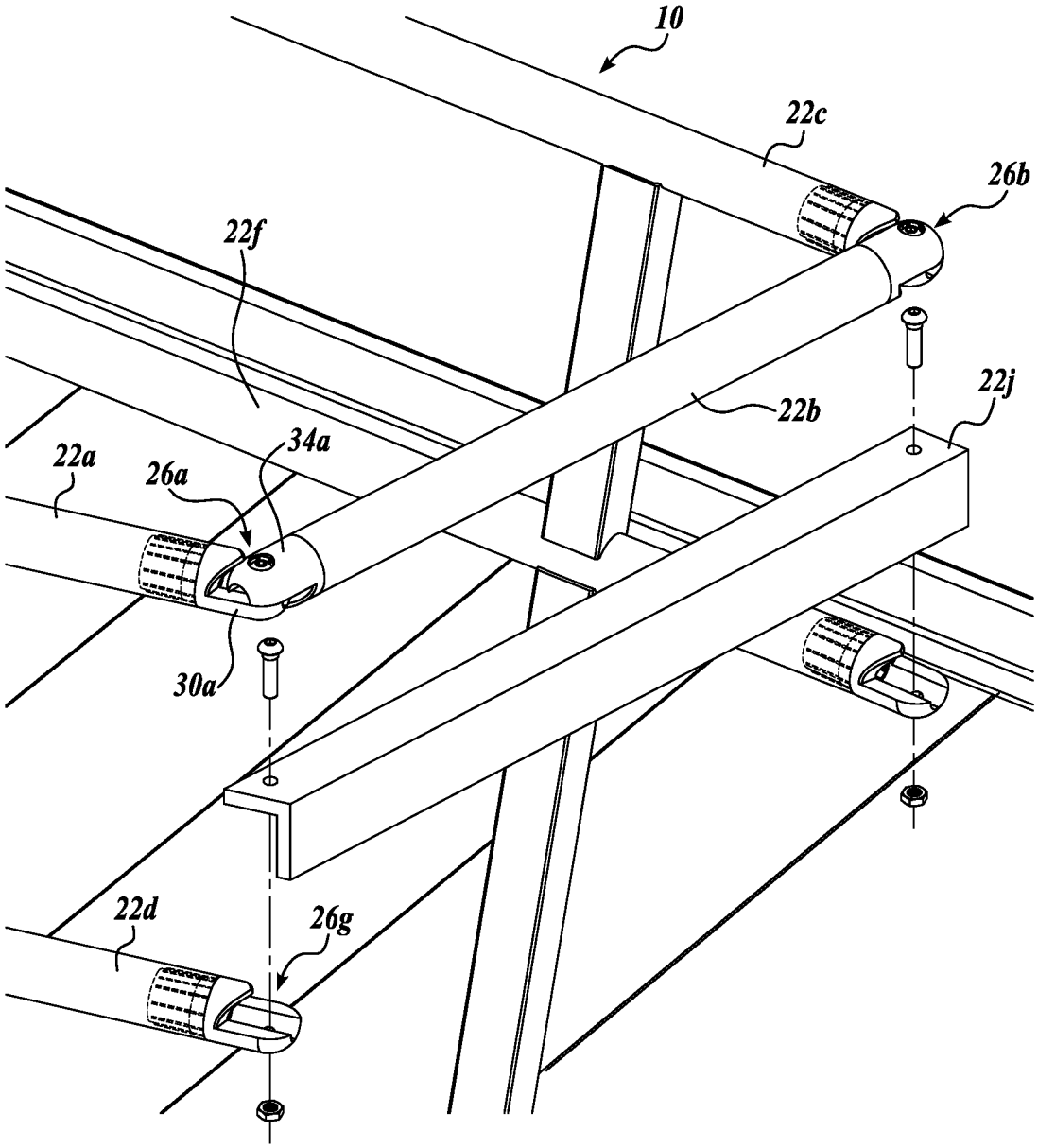
FIG. 17B is a partially exploded view of the handrail assembly of the ramp and platform assembly shown in FIG. 16.

In a second configuration, the elbow assembly 26 includes only the first elbow sub-part 30. In such an application, the base portion 50 of the first elbow sub-part 30 is inserted into a tubular portion of a first support member, and the first interface surface 122 and the second interface surface 124 of the first elbow sub-part 30 may be joined directly with a flat portion of a support member (e.g., a piece of angle metal as seen in FIGS. 16-17B).

To convert the elbow assembly 26 between the first configuration and the second configuration, a user removes the joining device 38 from the hinge bore 112 of the first elbow sub-part 30 and a corresponding hinge bore 112 of the second elbow sub-part 34, and then separates the first elbow sub-part 30 from the second elbow sub-part 34. The method may be reversed to convert the elbow assembly from the second configuration to the first configuration.

FIGS. 8-15 show other aspects of the elbow assembly 26 in order to better exhibit the ornamental design thereof. Inventive aspects of the illustrated design exist in each the elbow assembly as a whole, in individual portions and elements thereof, and in combinations of portions and elements thereof. Ornamentality may exist independent of any surface treatment and independent of certain structural features (such as protrusions 54).

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. An elbow assembly for a ramp and platform assembly, comprising:

a first elbow sub-part and a second elbow sub-part that are selectably and hingeably connectable to each other by a joining device, each of the first and second elbow sub-parts having:

a body defining a distal end, a proximal end, and a longitudinal axis extending therethrough, the body having:

a base portion extending from the distal end to an intermediate position located between the distal end and the proximal end, the base portion being configured for insertion into a tubing member; and a connecting portion extending from the intermediate position to the proximal end, the connecting portion having:

an arm portion extending to an end surface at the proximal end and having a first interface surface that is parallel to the longitudinal axis; and a guard portion having a first concave surface and a second concave surface that are oriented toward the arm portion, wherein a first outer edge of the first concave surface meets the arm portion at a first stop, and a second outer edge of the second concave surface meets the arm portion at a second stop;

wherein when the first elbow sub-part is connected to the second elbow sub-part:

the second elbow sub-part is configured to pivot relative to the first elbow sub-part within a range of motion between the first stop and the second stop;

the first interface surface of the first elbow sub-part interfaces with the first interface surface of the second elbow sub-part;

the end surface of the first elbow sub-part nests between the first interface surface and at least one of the first concave surface or the second concave surface of the second elbow sub-part; and the end surface of the second elbow sub-part nests between the first interface surface and at least one the first concave surface or the second concave surface of the first elbow sub-part;

wherein the first interface surface is coplanar with the longitudinal axis.

2. The elbow assembly of claim 1, wherein the distal end of the base portion of the body of each of the first and second elbow sub-parts are configured to attach directly to a flat portion of a support member via a joining member that extends through a central bore of the base portion and through the flat portion of the support member.

3. The elbow assembly of claim 1, wherein each of the first elbow sub-part and the second elbow sub-part includes a hinge bore surrounded by a recess that is configured to receive either of a bolt head or a nut, to enable reversible insertion of the joining device.

4. The elbow assembly of claim 1, wherein the first outer edge of the first concave surface and the second outer edge of the second concave surface are rounded.

5. The elbow assembly of claim 1, wherein when the first elbow sub-part is connected to the second elbow sub-part, the connecting portion of the first elbow sub-part defines a first radially outermost dimension of the elbow assembly on a first side of the longitudinal axis and the connecting portion of the second elbow sub-part defines a second radially outermost dimension of the elbow assembly on a second side of the longitudinal axis that is opposite the first side, wherein the guard portion of the first elbow sub-part does not project beyond the second radially outermost dimension of the second elbow sub-part on the second side of the longitudinal axis, and the guard portion of the second elbow sub-part does not project beyond the first radially outermost dimension of the first elbow sub-part on the first side of the longitudinal axis.

6. The elbow assembly of claim 1, wherein for each of the first elbow sub-part and the second elbow sub-part, the arm portion has a central bore extending therethrough, with the first interface surface located on a first side of the central bore and a second interface surface located on a second side of the central bore, the first interface surface being coplanar with the second interface surface, wherein when the first elbow sub-part is connected to the second elbow sub-part, the second interface surface of the first elbow sub-part interfaces with the second interface surface of the second elbow sub-part.

7. The elbow assembly of claim 1, wherein the base portion of the first elbow sub-part has a first diameter and the base portion of the second elbow sub-part has a second diameter, to facilitate connection between tubing members of different sizes.

8. The elbow assembly of claim 1, wherein for each of the first elbow sub-part and the second elbow sub-part, the end surface of the arm portion is rounded.

9. The elbow assembly of claim 8, wherein when the first elbow sub-part is connected to the second elbow sub-part, the first concave surface of the first elbow sub-part is configured to partially cover the end surface of the second elbow sub-part when the second elbow sub-part contacts the first stop of the first elbow sub-part, and the second concave surface of the first elbow sub-part is configured to partially cover the end surface of the second elbow sub-part when the second elbow sub-part contacts the second stop of the first elbow sub-part.

10. The elbow assembly of claim 8, wherein for each of the first elbow sub-part and the second elbow sub-part, the guard portion forms a peak where the first concave surface meets the second concave surface.

11. The elbow assembly of claim 10, wherein when the first elbow sub-part is connected to the second elbow sub-part, a radially outermost surface of the peak of the first elbow sub-part is coplanar with a radially outermost surface of the arm portion of the second elbow sub-part, and a radially outermost surface of the peak of the second elbow sub-part is coplanar with a radially outermost surface of the arm portion of the first elbow sub-part, in order to provide a transition between the first elbow sub-part and the second elbow sub-part at any angle within the range of motion.

12. The elbow assembly of claim 10, wherein for each of the first elbow sub-part and the second elbow sub-part, the first concave surface meets the second concave surface at a ridge that ends at the peak.

13. The elbow assembly of claim 1, wherein an intermediate surface that is perpendicular or oblique relative to the longitudinal axis is located at the intermediate position of the body.

14. A ramp and platform assembly, comprising:

a platform section having a walking surface;

a ramp section having a first end and a second end, the first end being connected to the platform section;

a first support member supported by at least one of the platform section or the ramp section;

a second support member; and a first elbow assembly connecting the first support member to the second support member, the first elbow assembly comprising:

a first elbow sub-part and a second elbow sub-part that are selectably and hingeably connectable to each other by a joining device, each of the first and second elbow sub-parts having:

a body defining a distal end, a proximal end, and a longitudinal axis extending therethrough, the body having:

a base portion from the distal end to an intermediate position located between the distal end and the proximal end, the base portion being configured for insertion into a tubing member; and a connecting portion extending from the intermediate position to the proximal end, the connecting portion having:

an arm portion extending to an end surface at the proximal end and having a first interface surface that is parallel to the longitudinal axis; and a guard portion having a first concave surface and a second concave surface that are oriented toward the arm portion, wherein a first outer edge of the first concave surface meets the arm portion at a first stop, and a second outer edge of the second concave surface meets the arm portion at a second stop;

wherein when the first elbow sub-part is connected to the second elbow sub-part, the second elbow sub-part is configured to pivot relative to the first elbow sub-part within a range of motion between the first stop and the second stop, the first interface surface of the first elbow sub-part interfaces with the first interface surface of the second elbow sub-part, the end surface of the first elbow sub-part nests between the first interface surface and at least one of the first concave surface or the second concave surface of the second elbow sub-part, and the end surface of the second elbow sub-part nests between the first interface surface and at least one the first concave surface or the second concave surface of the first elbow sub-part, wherein the base portion of the first elbow sub-part is joined with the first support member and the base portion of the second elbow sub-part is joined with the second support member, and wherein for each of the first elbow sub-part and the second elbow sub-part, the guard portion forms a peak where the first concave surface meets the second concave surface.

15. The ramp and platform assembly of claim 14, wherein the base portion of the first elbow sub-part is inserted into a tubing portion of the first support member and the base portion of the second elbow sub-part is inserted into a tubing portion of the second support member.

16. The ramp and platform assembly of claim 14, wherein for each of the first elbow sub-part and the second elbow sub-part, the arm portion has a central bore extending therethrough, with the first interface surface located on a first side of the central bore and a second interface surface located on a second side of the central bore, wherein the first interface surface is coplanar with the second interface surface, wherein the second interface surface of the first elbow sub-part interfaces with the second interface surface of the second elbow sub-part.

17. The ramp and platform assembly of claim 14, wherein the base portion of the first elbow sub-part is attached directly to a flat portion of the first support member via a joining member that extends through a central bore of the base portion and through the flat portion of the first support member, and wherein the base portion of the second elbow sub-part is inserted into a tubing portion of the second support member.

18. The ramp and platform assembly of claim 14, wherein the first elbow sub-part is configured to selectably and hingeably connect to the second elbow sub-part.

19. An elbow assembly for a ramp and platform assembly, comprising:

a first elbow sub-part and a second elbow sub-part that are selectably and hingeably connectable to each other by a joining device, each of the first and second elbow sub-parts having:

a body defining a distal end, a proximal end, and a longitudinal axis extending therethrough, the body having:

a base portion extending from the distal end to an intermediate position located between the distal end and the proximal end, the base portion being configured for insertion into a tubing member; and a connecting portion extending from the intermediate position to the proximal end, the connecting portion having:

an arm portion extending to an end surface at the proximal end and having a first interface surface that is parallel to the longitudinal axis; and a guard portion having a first concave surface and a second concave surface that are oriented toward the arm portion, wherein a first outer edge of the first concave surface meets the arm portion at a first stop, and a second outer edge of the second concave surface meets the arm portion at a second stop;

wherein when the first elbow sub-part is connected to the second elbow sub-part:

the second elbow sub-part is configured to pivot relative to the first elbow sub-part within a range of motion between the first stop and the second stop;

the first interface surface of the first elbow sub-part interfaces with the first interface surface of the second elbow sub-part;

the end surface of the first elbow sub-part nests between the first interface surface and at least one of the first concave surface or the second concave surface of the second elbow sub-part; and the end surface of the second elbow sub-part nests between the first interface surface and at least one the first concave surface or the second concave surface of the first elbow sub-part;

wherein for each of the first elbow sub-part and the second elbow sub-part, the end surface of the arm portion is rounded, and wherein for each of the first elbow sub-part and the second elbow sub-part, the guard portion forms a peak where the first concave surface meets the second concave surface.

* * * * *